United States Patent [19]

Carr

[11] Patent Number: 4,981,314

[45] Date of Patent: Jan. 1, 1991

[54] DOOR KNOB

[76] Inventor: Anthony L. Carr, 1400 SW. Afton St., Topeka, Kans. 66611

[21] Appl. No.: 306,637

[22] Filed: Feb. 6, 1989

[51] Int. Cl.[5] ..... E05B 1/00

[52] U.S. Cl. ..... 292/347; D8/305

[58] Field of Search ..... D8/300, 301, 302, 305, D8/310, 321, 322; 292/347, 336.3; 70/224; 250/466.1; 362/100; 116/9, 10, 139, 142, 153

[56] References Cited

U.S. PATENT DOCUMENTS

| | | | |
|---|---|---|---|
| D. 179,663 | 2/1957 | Spadini | D8/305 |
| D. 183,314 | 8/1958 | Johnson | D8/305 |
| D. 185,814 | 8/1959 | Johnson | D8/305 |
| D. 195,587 | 7/1963 | Denker | D8/310 |
| 273,685 | 3/1883 | Huntley | 292/347 |
| 706,878 | 8/1902 | Atkinson | 116/139 |
| 830,395 | 9/1906 | Wilson | 116/139 |
| 1,263,880 | 4/1918 | Glossop | 292/347 |
| 1,402,514 | 1/1922 | Kwasnieski | 116/153 |
| 1,567,954 | 12/1925 | Kalm | 292/347 |
| 1,627,467 | 5/1927 | Sparlin | 116/142 FP |
| 2,122,953 | 7/1938 | Robertson | 116/153 |
| 2,188,264 | 1/1940 | Fordyce | 250/466.1 |
| 2,492,740 | 12/1949 | Garratt | 116/142 R |
| 2,608,784 | 9/1952 | Lando | 116/139 |
| 2,699,809 | 1/1955 | Nebe et al. . | |
| 2,721,597 | 10/1955 | Pitrella . | |
| 2,997,089 | 8/1961 | Amdur et al. . | |
| 2,999,523 | 9/1961 | Amdur et al. . | |
| 3,024,555 | 3/1962 | Abeles | 292/347 X |
| 3,168,730 | 2/1965 | Baldinelli | 116/153 |
| 3,343,578 | 9/1967 | Rubin . | |
| 3,416,488 | 12/1968 | Merl | 116/139 |
| 3,774,572 | 11/1973 | Borraccio | 116/139 X |

OTHER PUBLICATIONS

Schlage Catalogue, 1962, p. 9.

*Primary Examiner*—Richard E. Moore
*Assistant Examiner*—Michael J. Milano
*Attorney, Agent, or Firm*—Jerry T. Kearns

[57] ABSTRACT

A door knob has a generally spherical flattened configuration with a front face provided with a representation of a human eye. The eye may be integrally formed with the door knob or bonded thereto. Various portions of the eye may be treated with a luminescent or phosphorescent paint such that the eye will glow in the dark. The door knob serves as a novelty item which also functions as an indicator for the position of the door knob at night due to the luminescent or phosphorescent treatment. In a second embodiment, the human eye representation is separately formed as a cylindrical plug rotatably mounted in a circular aperture formed through a front face of the door knob. A key hole is formed centrally through the pupil of the eye in alignment with a conventional lock cylinder. The glowing eye serves as a position indicator at night time to indicate the position of the key hole. In a third embodiment of the invention, the human eye is mounted for limited axial movement and serves to actuate a bellows type sound producing mechanism within the door knob.

2 Claims, 4 Drawing Sheets

DOOR KNOB

BACKGROUND OF THE INVENTION

1. Field of the Invention

The present invention relates to door knobs, and more particularly pertains to a novelty door knob including a representation of a human eye. A wide variety of conventional door knobs are known in the prior art. The present invention seeks to provide an amusing and useful door knob which serves as an indicator, an ornament and as an ornamental door bell device.

2. Description of the Prior Art

Various types of door knobs are known in the prior art. A typical example of such a door knob is to be found in U.S. Pat. No. 2,699,809, which issued to K. Nebe et al on Jan. 18, 1955. This patent discloses a door knob cushion for attachment over a conventional door knob which serves to protect furniture and walls from damage by a projecting knob on an opening door. U.S. Pat. No. 2,721,597, which issued to F. Pitrella on Oct. 25, 1955, discloses a similar door knob cover constructed of a resilient elastic material designed to be frictionally engaged over a conventional spherical door knob. U.S. Pat. No. 2,999,523,which issued to C. Amdur et al on Sept. 12, 1961, discloses an ornamental split door knob cover having a removable central ornamental disk. U.S. Pat. No. 2,997,089, which issued to C. Amdur et al on Aug. 22, 1961, discloses another door knob cover having resilient pad portions formed on one half of a two piece cover. Threads are provided for securing the cover halves over an existing spherical door knob. U.S. Pat. No. 3,343,578, which issued to M. Rubin on Sept. 26, 1967, discloses a generally cubical door knob cover formed from a fabric material and secured by a stretchable elastic tape.

While the above mentioned devices are suited for their intended usage, none of these devices disclose a door knob provided with a representation of a human eye. Additional features of the present invention, not disclosed by the aforesaid prior art devices, include the provision of a door knob with a human eye representation treated with a phosphorescent or luminescent material to provide a night time key hole indicator. Additionally, none of these prior art devices disclose the use of an axially reciprocal human eye representation to actuate a sound producing device within a door knob. Inasmuch as the art is relatively crowded with respect to these various types of door knobs, it can be appreciated that there is a continuing need for and interest in improvements to such door knobs, and in this respect, the present invention addresses this need and interest.

SUMMARY OF THE INVENTION

In view of the foregoing disadvantages inherent in the known types of door knobs now present in the prior art, the present invention provides an improved door knob. As such, the general purpose of the present invention, which will be described subsequently in greater detail, is to provide a new and improved door knob which has all the advantages of the prior art door knobs and none of the disadvantages.

To attain this, representative embodiments of the concepts of the present invention are illustrated in the drawings and make use of a door knob having a generally spherical flattened configuration with a front face provided with a representation of a human eye. The eye may be integrally formed with the door knob or bonded thereto. Various portions of the eye may be treated with a luminescent or phosphorescent paint such that the eye will glow in the dark. The door knob serves as a novelty item which also functions as an indicator for the position of the door knob at night due to the luminescent or phosphorescent treatment. In a second embodiment, the human eye representation is separately formed as a cylindrical plug rotatably mounted in a circular aperture formed through a front face of the door knob. A key hole is formed centrally through the pupil of the eye in alignment with a conventional lock cylinder. The glowing eye serves as a position indicator at night time to indicate the position of the key hole. In a third embodiment of the invention, the human eye is mounted for limited axial movement and serves to actuate a bellows type sound producing mechanism within the door knob.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door knot which has all the advantages of the prior art door knobs and none of the disadvantages.

It is another object of the present invention to provide a new and improved door knob which may be easily and efficiently manufactured and marketed.

It is a further object cf the present invention to provide a new and improved door knob which is of a durable and reliable construction.

An even further object of the present invention is to provide a new and improved door knob which is susceptible of a low cost of manufacture with regard to both materials and labor, and which accordingly is then susceptible of low prices of sale to the consuming public, thereby making such door knobs economically available to the buying public.

Still yet another object of the present invention is to provide a new and improved door knob which provides in the apparatuses and methods of the prior art some of the advantages thereof, while simultaneously overcoming some of the disadvantages normally associated therewith.

Still another object of the present invention is to provide a new and improved door knob with an ornamental representation of a human eye.

Yet another object of the present invention is to provide a new and improved door knob having an ornamental representation of a human eye treated with a luminescent or phosphorescent material to serve as a night light and a door knob position indicator.

Even still another object of the present invention is to provide a new and improved door knob having a human eye representation which serves as a key hole indicator.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
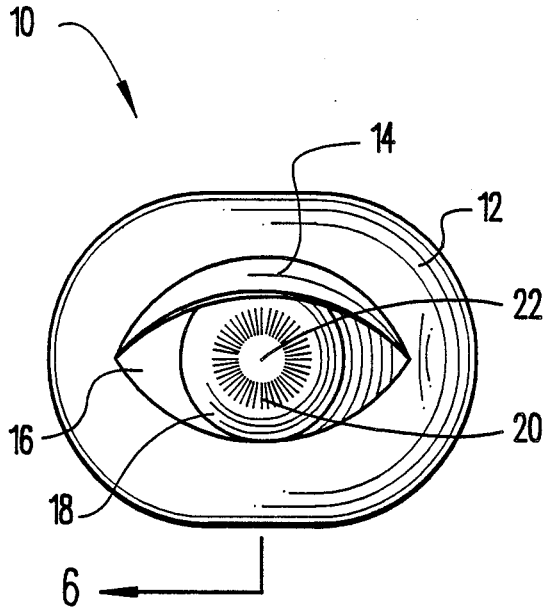
FIG. 1 is a front view of a door knob according to a first embodiment of the present invention.

With reference now to the drawings, and in particular to FIG. 1 thereof, a new and improved door knob embodying the principles and concepts of the present invention and generally designated by the reference numeral 10 will be described.

More specifically, it will be noted that the first embodiment 10 of the invention includes a flattened generally spherical door knob portion 12 bearing a representation of a human eye. The human eye representation has an eyelid portion 14 and an eye white portion 16 as well as iris portions 18 and 20 and a pupil portion 22. The door knob portion 12 is preferably molded from a high impact plastic material and may be integrally molded with the representation of the human eye. Alternatively, the human eye representation may be separately formed and adhesively bonded or secured to the door knob portion 12. Various portions of the human eye representation including portions 14, 16, 18, 20 and 22 may be treated with a phosphorescent or luminescent material to produce a glowing effect at night or in the dark. The phosphorescent or luminescent material may take the form of a treated paint or a plastic material treated prior to the molding process. The door knob 10 according to the first embodiment of the invention is designed for use on interior doors not requiring a key lock mechanism. The device serves as an ornamental novelty item for children and, when treated with the phosphorescent or luminescent material, functions as a night light and as an indicator for the position of the door knob.

Figure 2:
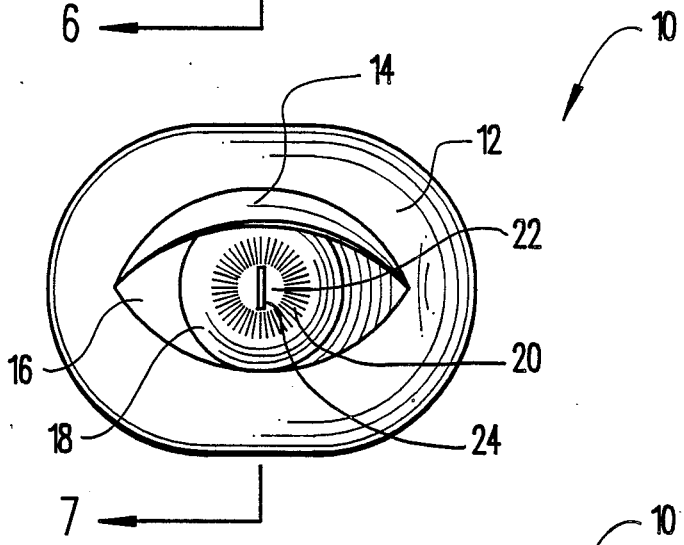
FIG. 2 is a front view of a door knob according to a second embodiment of the present invention.

FIG. 2 illustrates a slightly modified door knob 10' according to a second embodiment of the present invention. The door knob 10' is generally similar with respect to the first embodiment 10 described previously, with the exception that a key slot 24 is provided centrally through the pupil portion 22 of the human eye representation. As with the first embodiment 10, various portions of the human eye representation may be treated with a phosphorescent or luminescent material. It is particularly advantageous that the pupil portion 22 be so treated to provide an indicator of the position of the key slot 24.

Figure 3:
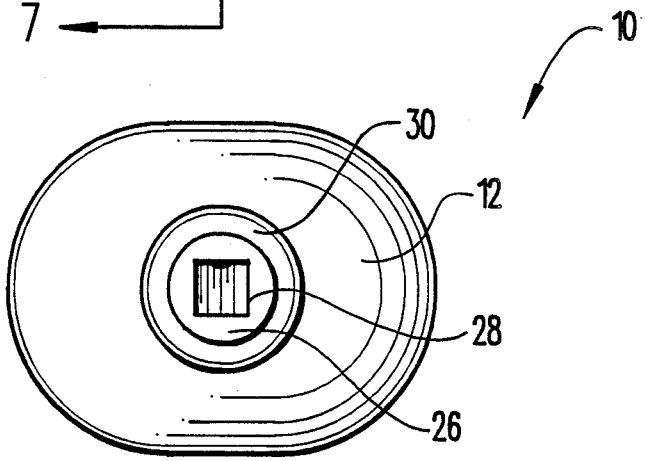
FIG. 3 is a back view of the door knob of the second embodiment of the present invention.

FIG. 3 provides a back view of the door knob 10' which illustrates a shank portion 26 having an elongated rectangular recess 28 for the insertion of the shaft of a conventional door latch mechanism. A radial rim 30 is formed around the shank portion 26 to serve as a positioning locator to assist in mounting the door knob 10' on a conventional door latch mechanism.

Figure 4:
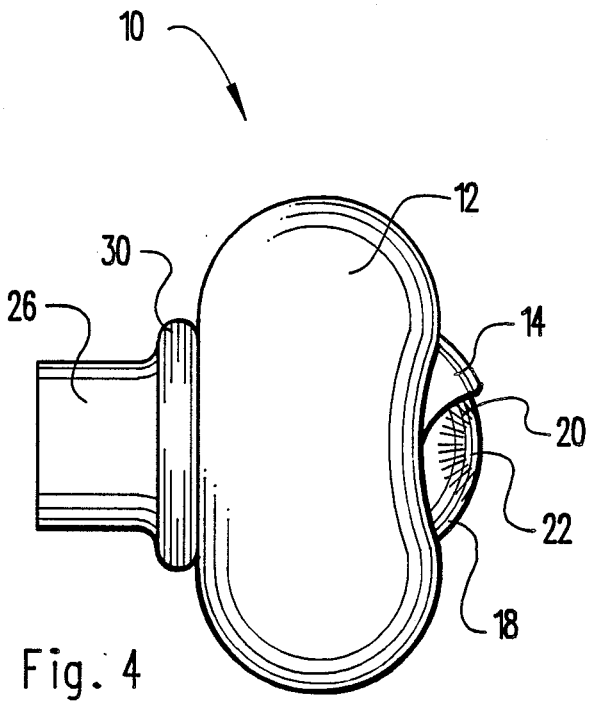
FIG. 4 is a side view of the door knob of the first embodiment of the present invention.

FIG. 4 depicts a side view of the first embodiment 10 of the present invention which illustrates the shank portions 26 and radial rim 30. It should be noted that eyelashes may be simulated on the eyelid portion 14 by the attachment of suitable plastic or fabric filaments.

Figure 5:
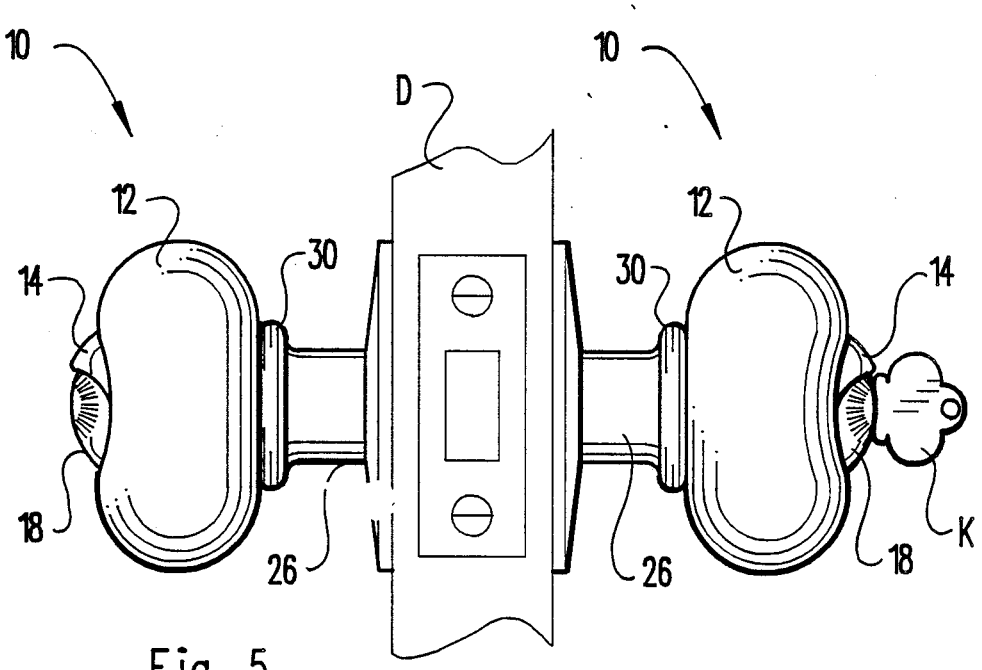
FIG. 5 is a side view illustrating door knobs according to the first and second embodiments of the invention mounted on opposite sides of a door.

FIG. 5 illustrates a portion of a conventional door D having a conventional door latch mechanism provided with door knobs according to the first 10 and second 10' embodiments of the invention. The door knob 10' is provided on the exterior surface of the door D and has an internal conventional door lock cylinder mechanism actuated by a conventional key K. The door knob 10 according to the first embodiment of the invention is provided on the interior surface of the door D.

Figure 6:
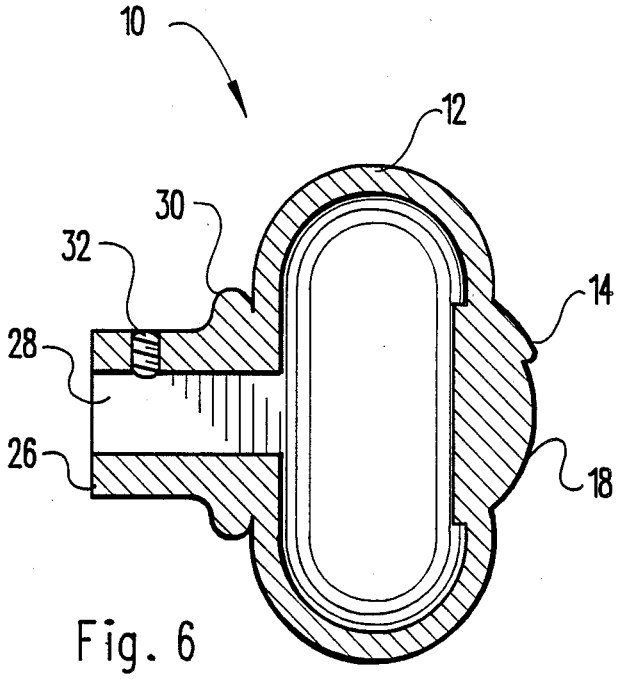
FIG. 6 is a cross sectional view, taken along line 6 of FIG. 1.

FIG. 6 provides a cross sectional view, taken along line 6 of FIG. 1, which illustrates the interior construction of the door knob 10. A set screw 32 is received through a transverse threaded aperture and communicates with the recess 28 to secure the door knob 10 on the shaft of a conventional door latch mechanism. The human eye representation 18 may be integrally formed with the door knob portion 12 or may be separately molded and adhesively bonded thereto.

Figure 7:
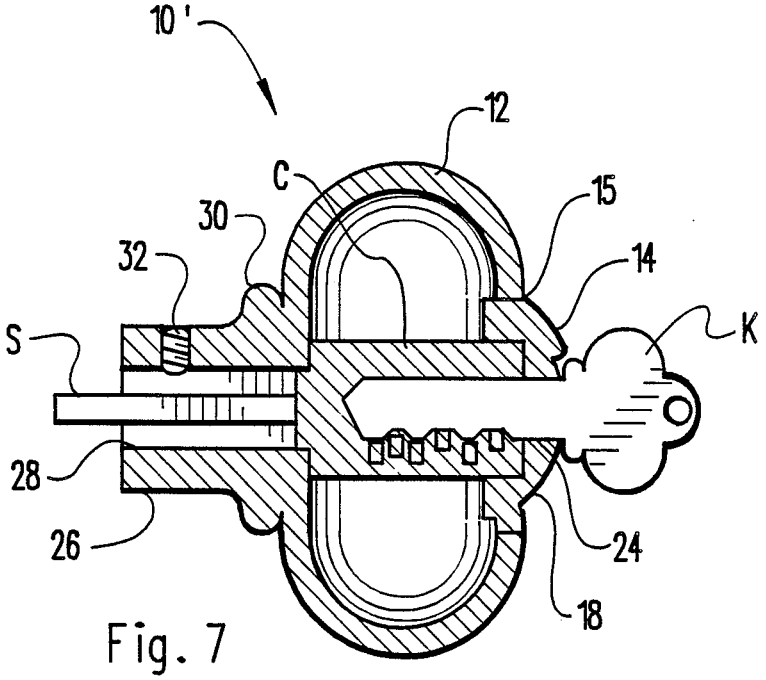
FIG. 7 illustrates a cross sectional view, taken along line 7 of FIG. 2.

FIG. 7 illustrates a cross sectional view, taken along line 7 of FIG. 2, which illustrates the construction of the door knob 10'. The human eye representation 18 is rotatably mounted in a circular aperture 15 provided through the front face of the door knob portion 12. The key slot 24 communicates with a conventional lock cylinder mechanism C mounted within the interior of the knob portion 12. Thus, upon rotation of the key K, the human eye representation 18 rotates within a circular aperture 15. The lock cylinder mechanism C includes a conventional rotary rectangular shaft S which communicates in a conventional fashion with the door latch. By tightening the set screw 32, the door knob 10' is secured to the shaft S.

Figure 8:
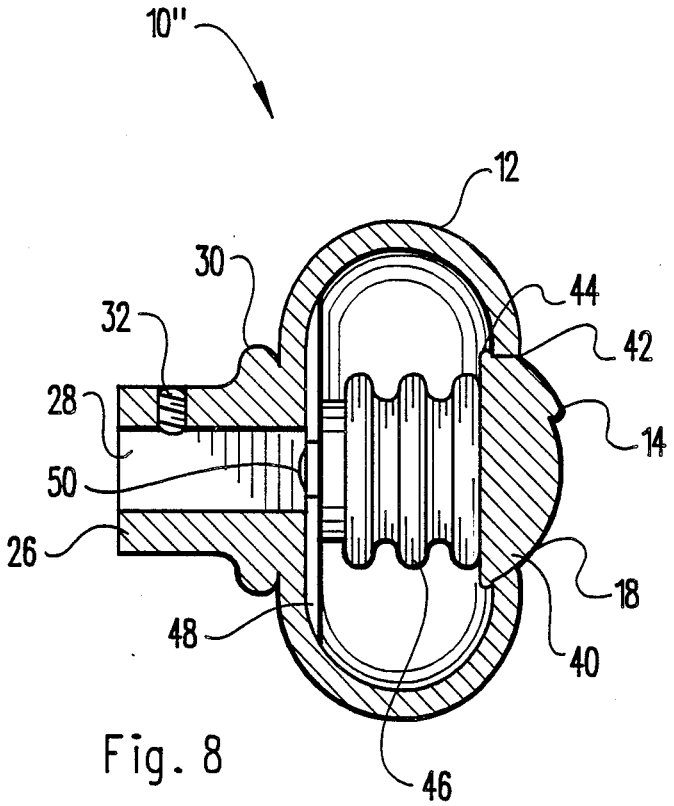
FIG. 8 illustrates a cross sectional view of a door knob according to a third embodiment of the present invention.

FIG. 8 illustrates a door knob according to a third embodiment 10'' of the invention. The door knob 10'' is similarly constructed as described previously with reference to the second embodiment 10' of the invention, with the exception that a bellows sound producing device 46 is received within the hollow interior of the door knob portion 12. The human eye representation 18 is formed as a generally cylindrical plug 40 which is received for limited axial reciprocation in an aperture 42 formed through the front face cf the knob portion 12. The bellows 46 is preferably formed from a resilient elastomeric material such as rubber and has an inner end secured to a plate 48 stationarily mounted within the interior of the knob portion 12. An air outlet aperture 50 of the bellows 46 is configured in a conventional fashion to produce a sound upon contraction of the bellows 46. The outer end of the bellows 46 is secured to the inner face of the human eye representation 18. Upon depressing the human eye representation 18, the bellows 46 is contracted, producing a sound by the outlet of air through the aperture 50. Upon release of the human eye representation 18, the resilient bellows 46 biases the eye representation 18 outwardly, until such outward movement is limited by contact of a circular retaining flange 44 on the inner face of the plug 40 with an interior surface of the front face of the door knob portion 12. It should be understood that the sound producing device may be combined with a conventional key lock cylinder mechanism as illustrated in FIG. 7. Additionally, the various portions of the human eye representation 18 may be treated with a phosphorescent or luminescent material as described previously.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door knob, comprising:

a knob portion having a hollow interior and a front face;

an aperture formed through said front face of said knob portion and communicating with said hollow interior;

a representation of a human eye received for limited reciprocal axial movement through said aperture into said hollow interior;

a shank portion connected to said knob portion;

said shank portion having an elongated recess communicating with said hollow interior;

means for securing said shank portion to a shaft of a conventional door latch mechanism;

a bellows in said hollow interior of said knob portion, said bellows having an air outlet orifice configured to produce sound upon contraction of said bellows, said air outlet orifice disposed in alignment with said elongated recess in said shank for directing sound waves through said shank into a room interior;

an inner face of said human eye representation secured to one end of said bellows;

said bellows formed from a resilient material and axially outwardly biasing said human eye representation through said aperture in said knob portion; and a radially extending retaining flange formed on an inner face of said human eye representation for retaining said human eye representation partially within said knob portion.

2. The door knob of claim 1, wherein said human eye representation is at least partially treated with a luminescent or phosphorescent material.

* * * * *